US011165158B2

(12) United States Patent
Wu et al.

(10) Patent No.: US 11,165,158 B2
(45) Date of Patent: Nov. 2, 2021

(54) INTEGRATED ANTENNA ELEMENT, ANTENNA UNIT, MULTI-ARRAY ANTENNA, TRANSMISSION METHOD AND RECEIVING METHOD OF SAME

(71) Applicant: TONGYU COMMUNICATION INC., Zhongshan (CN)

(72) Inventors: Zhonglin Wu, Zhongshan (CN); Samb Doudou, Zhongshan (CN); Ari Isola, Zhongshan (CN); Can Ding, Zhongshan (CN); Haihan Sun, Zhongshan (CN); Yingjie Guo, Zhongshan (CN); Shuguang Shao, Zhongshan (CN)

(73) Assignee: TONGYU COMMUNICATION INC., Zhongshan (CN)

( * ) Notice: Subject to any disclaimer, the term of this patent is extended or adjusted under 35 U.S.C. 154(b) by 0 days.

(21) Appl. No.: 16/484,198

(22) PCT Filed: May 12, 2017

(86) PCT No.: PCT/CN2017/084202
§ 371 (c)(1),
(2) Date: Aug. 7, 2019

(87) PCT Pub. No.: WO2018/205278
PCT Pub. Date: Nov. 15, 2018

(65) Prior Publication Data
US 2020/0006858 A1 Jan. 2, 2020

(51) Int. Cl.
*H01Q 9/28* (2006.01)
*H01Q 1/38* (2006.01)
(Continued)

(52) U.S. Cl.
CPC ..... *H01Q 9/285* (2013.01); *H01Q 1/38* (2013.01); *H01Q 15/14* (2013.01); *H01Q 21/29* (2013.01)

(58) Field of Classification Search
CPC ..... H01Q 1/246; H01Q 1/36; H01Q 1/38; H01Q 9/26; H01Q 9/285; H01Q 15/14; H01Q 25/001
(Continued)

(56) References Cited

U.S. PATENT DOCUMENTS 6,067,053 A * 5/2000 Runyon ..... H01Q 1/246 343/700 MS
8,708,446 B2 * 4/2014 Kondo ..... B41J 11/002 347/16
(Continued)

FOREIGN PATENT DOCUMENTS

CN 102299409 A 12/2011
CN 204011714 U 12/2014
(Continued)

OTHER PUBLICATIONS

Feb. 6, 2018 International Search Report issued in International Patent Application No. PCT/CN2017/084202.

*Primary Examiner* — Tung X Le
(74) *Attorney, Agent, or Firm* — Oliff PLC

(57) ABSTRACT

An integrated antenna element includes a top PCB and a bottom PCB arranged in a laminate structure. Radiating surface units are arranged between the top PCB and the bottom PCB. A first balun and a second balun set separately set on the top and bottom PCBs respectively, each for different polarization. The integrated antenna element is capable of transmitting signals to a base station and receiving signals from a base station.

22 Claims, 6 Drawing Sheets

(51) Int. Cl.
*H01Q 15/14* (2006.01)
*H01Q 21/29* (2006.01)

(58) Field of Classification Search
USPC ..... 257/428; 438/57; 343/793, 803, 821, 343/893
See application file for complete search history.

(56) References Cited

U.S. PATENT DOCUMENTS

| | | | | |
|---|---|---|---|---|
| 9,391,375 | B1 * | 7/2016 | Bales | H01Q 21/24 |
| 9,548,544 | B2 * | 1/2017 | Watson | H01Q 19/108 |
| 9,806,422 | B2 * | 10/2017 | Garcia | G06K 19/07749 |
| 10,505,279 | B2 * | 12/2019 | Celik | H01Q 9/0464 |
| 2004/0004576 | A1 * | 1/2004 | Anderson | H01Q 21/064 343/770 |
| 2011/0043424 | A1 * | 2/2011 | Lee | H01Q 9/285 343/816 |
| 2016/0226156 | A1 | 8/2016 | So et al. | |
| 2017/0077614 | A1 | 3/2017 | Lin et al. | |

FOREIGN PATENT DOCUMENTS

| | | | |
|---|---|---|---|
| CN | 204189960 | U | 3/2015 |
| CN | 104852150 | A | 8/2015 |
| CN | 105186140 | A | 12/2015 |
| CN | 205335424 | U | 6/2016 |
| CN | 106207444 | A | 12/2016 |

* cited by examiner

INTEGRATED ANTENNA ELEMENT, ANTENNA UNIT, MULTI-ARRAY ANTENNA, TRANSMISSION METHOD AND RECEIVING METHOD OF SAME

TECHNICAL FIELD

This application generally relates to the field of communication system, and particularly, to an integrated antenna element, an antenna unit and a multi-array antenna of the same.

BACKGROUND ART

Regular antenna systems are challenged by:

High-rise building coverage: limited directive antennas (in azimuth/elevation plane) resulting on limitation in terms of high order sectorization.

capacity lift at Macro Site and Uplink Coverage & Capacity Limited: for a given allocated time-frequency, there being still a challenge during multiplexing of different users due to small number of available antennas being able to direct azimuth narrow beam at the desired direction while nulling interferers of intra- and inter-cell efficiently; besides, business expansion along with difficulty in acquiring new site where UL:DL is 1:3; and High In-Building Capacity growth: even in claimed SU-MIMO, resources being not exploited fully due to limited size of user devices; besides, higher cost for in-building system, with poor WLAN performance.

Massive MIMO antennas have been recently investigated to tackle the above challenges and being Key technology driving 4.5G and beyond.

In traditional Massive MIMO antennas, a set of radiating elements (known as subarrays) are combined in the vertical plane to boost more gain. Also the antenna has a number of antenna ports with additional connectors, and a number of Transmitting/Receiving circuits (from RRU). From this, the antenna dimension is increased, the feed lines are complex. Also, it can be noted extra weight and cost with multiple filters and additional connectors and wasted space between radiating surface unit and antenna reflector. In addition, this imposes costly development and implementation resources as multiple soldering points between radiating elements and the feeding network.

Technical Problem

A main object of the present invention is to provide an integrated antenna element, which has a compact structure with good inter-port isolation, stable pattern beamwidth and high-gain per polarization port for one radiating element.

A second object of the present invention is to provide an antenna unit, which can simplify the antenna-array structure, improve the antenna capacity and exploitation with good radiating performance.

A further object of the present invention is to provide a multi-array antenna, which can obtain a Massive MIMO antenna.

Another object of the present invention is to provide an transmitting method of an integrated antenna unit.

A final object of the present invention is to provide an receiving method of an integrated antenna unit.

Solution to Problem

Technical Solution

To obtain the above object, an integrated antenna element provided in the present invention comprising: a compact printed board; and radiating elements. The compact printed board comprise: a top PCB and a back PCB in a laminate structure. Each radiating element comprises: a radiating surface unit and a layered-balun. The layered-balun comprises a first balun and a second balun each separately set on the different PCB. The first balun, the second balun and the radiating surface unit are spaced each other with the radiating surface unit sandwiched therebetween, are coupled to each other, and are integrated with the compact printed board.

In some embodiments, the same baluns are set in the same plane.

In some embodiments, the radiating surface unit is set between the top PCB and the bottom PCB; the first balun is attached to the top PCB for a first polarization and the second balun is attached to the bottom PCB for a second polarization; and the first balun, the second balun and the radiating surface unit are spaced along a thickness of the compact printed board.

In some embodiments, the top PCB is placed on the bottom PCB each with an inner surface opposite; the first balun is set on a top surface of the compact printed board, and is coupled to the radiating surface unit to form a first dipole for the first polarization; the second balun is set at a bottom surface of the compact printed board, and is coupled to the radiating surface unit to form a second dipole for the second polarization; and the radiating surface unit is set on the inner surface of the top PCB or the bottom PCB.

In some embodiments, the first balun and the second balun is overlapped to form a cross at a center of the radiating surface unit in such a dimensional arrangement to form a dual polarization.

In some embodiments, the radiating surface unit comprises radiating arms in a folded shape with length depending on an electrical length of a current distributed in the radiating element.

In some embodiments, the integrated antenna element further comprises a power splitter connected to the layered-balun; each power splitter comprises one input and at least two outputs; wherein a primary power splitter is set on the top PCB with each output thereof connected to one first balun; and a secondary power splitter is set on the bottom PCB with each output thereof connected to one second balun.

In some embodiments, the power splitter is connected to the layered-balun via holes in the layered-balun.

In some embodiments, the radiating surface unit is made from conductive material, and has a shape corresponding to dipoles of each radiating element; the first and the second baluns are made from conductive material, and are adapted for the radiating surface unit.

In some embodiments, the radiating surface unit is configured as a square strip combined by four sub-squares each with a hole therein; the first and the second baluns are configured each as a rectangular line with one part cut; the cut is located in the middle of one length of the rectangle.

In some embodiments, the first and the second baluns have each a length to match 50 or 75 Ohm impedance of each dipole.

To obtain the above object, an antenna unit provided in accordance with embodiment of the present invention, comprise an integrated antenna element described above, a reflecting board and a filtering equipment, wherein the reflecting board is placed below the integrated antenna element.

In some embodiments, the filtering equipment is accommodated in a space between the integrated antenna element and the reflecting board, and is set on the reflecting board.

In some embodiments, the reflecting board is placed below the integrated antenna element with two side walls running parallel; the reflecting board is parallel to the compact printed board with a distance of ¼λ, where λ is the wavelength at a center frequency of the radiating element.

In some embodiments, the filtering equipment has at least two inputs and at least two outputs thus to form a dual-channel structure.

In some embodiments, the filtering equipment comprises: at least two band-pass filters which are a primary band-pass filter and a secondary band-pass filter; the primary band-pass filter has one input and one output, the output is placed beneath the compact printed board, and is connected directly to the primary power splitter via a matched transmission line; the secondary band-pass filter has one input and one output, the output is placed beneath the compact printed board, and is connected directly to the secondary power splitter via another matched transmission line.

In some embodiments, each band-pass filter serves as a support of a fixture structure of the integrated antenna element to the reflecting board.

In some embodiments, the matched transmission line is a cable traversing a filter cavity of each band-pass filter via a hole in a top of the band-pass filter; the cable supports the compact printed board and the radiating element above the reflecting board.

To obtain the object, a multi-array antenna provided in accordance with the present invention, comprises multiple antenna units described above, the multiple antenna units are mounted on a reflecting board, and located between two running side walls.

In some embodiments, the multi-array antenna has multiple band-pass filters, the multiple band-pass filters are connected to a radio unit thus to form a multi-array active antenna.

To obtain the object, an transmitting method of an integrated antenna unit provided in accordance with the embodiments of the present invention, comprises: receiving signals from a base station antenna transmitting path via two inputs of the dual-channel band-pass filtering equipment; filtering signals and outputting the signals to outputs of a primary and a secondary power splitters; splitting each input signal using the splitters; sending the signals to a corresponding radiating element via a primary and a secondary baluns each located at a separated PCB; and radiating a received signal throughout the space by the radiating element.

Finally, a receiving method of an integrated antenna unit provided in accordance with the embodiments of the present invention, comprises: receiving signals using radiating elements; sending received signals to a corresponding power splitter via respective balun; receiving outputting signals of the splitters and filtering the signals by a corresponding band-pass filter; and sending filtered signal of interest to a base station antenna receiving path.

Advantageous Effects of Invention

Advantageous Effects

In accordance with the embodiments, the present invention has advantages that: a compact antenna element unit can be obtained since the radiating elements are integrated with a compact printed board; further, the baluns of two polarizations respectively set on a separated board contributes much in terms of inter-port isolation, ease of antenna feeding drawing, a stable pattern beamwidth and high-gain. And a compact sized of the antenna can be obtained.

Further, the antenna unit has a simple structure and high capacity because of the compact antenna element, and the space between the radiating elements and the reflecting board can be used efficiently by adding a compact band-pass filter therebetween, and cost effective compact integrated antenna unit can be obtained which is also easy to manufacture especially.

A large scale MIMO antenna is to be produced as there are less soldering parts and reduced connectors.

The above-mentioned features, as well as other features, aspects, and advantages of the present technology will now be described in connection with various embodiments of the invention, in reference to the accompanying drawings. The illustrated embodiments, however, are merely examples and are not intended to limit the invention.

BRIEF DESCRIPTION OF DRAWINGS

Description of Drawings

Figure 1:
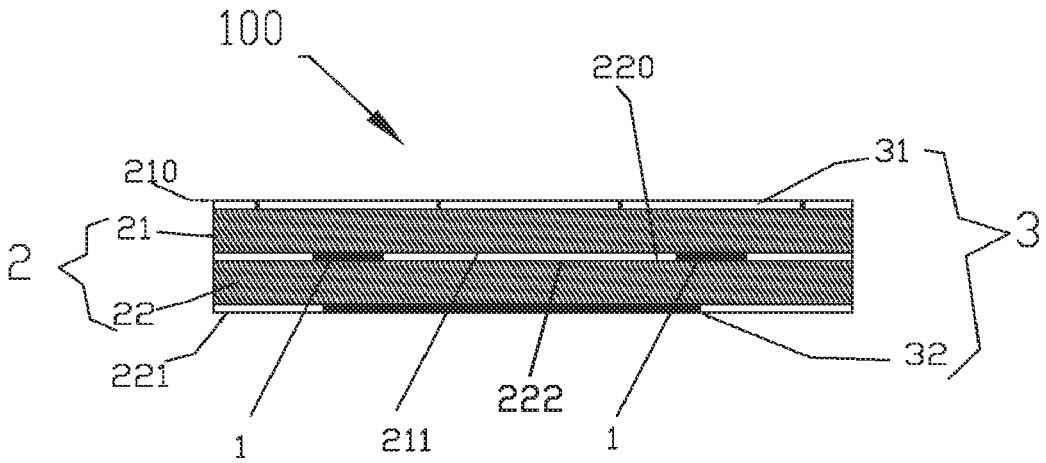
Figure 2:
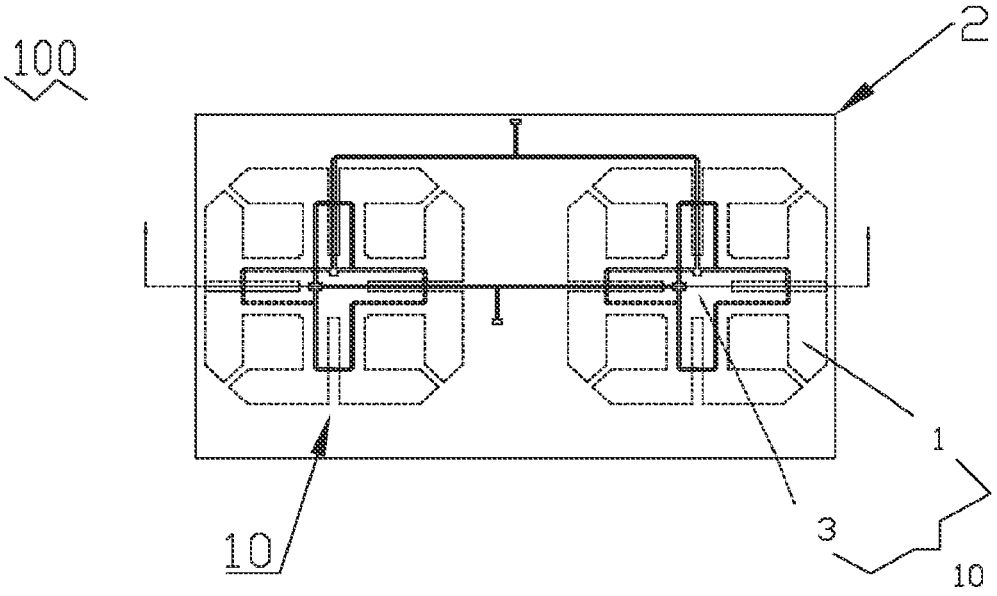
Figure 3:
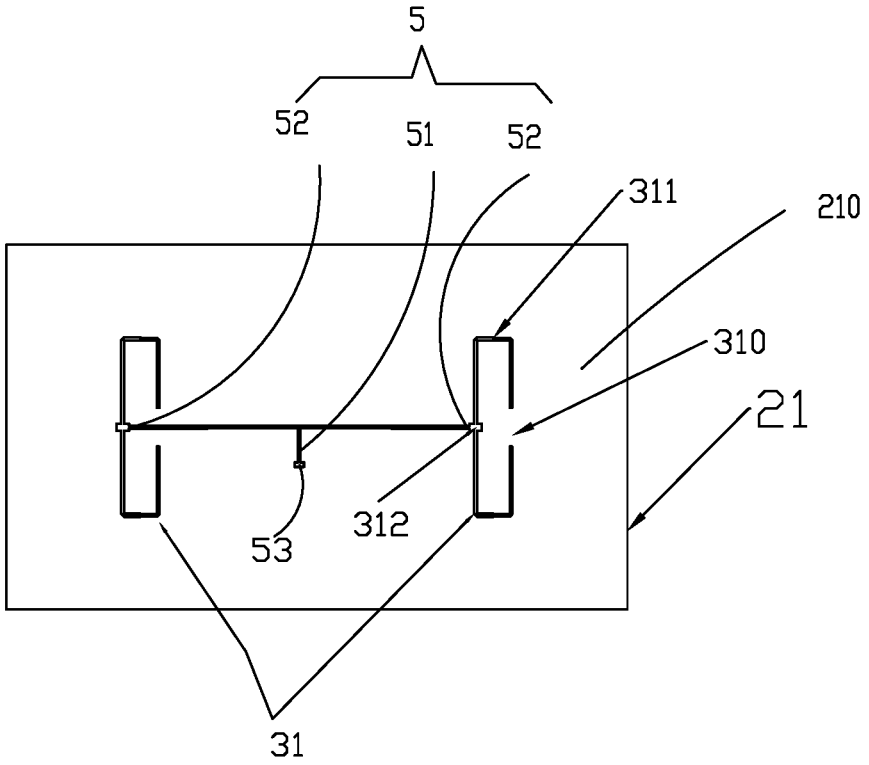
Figure 4:
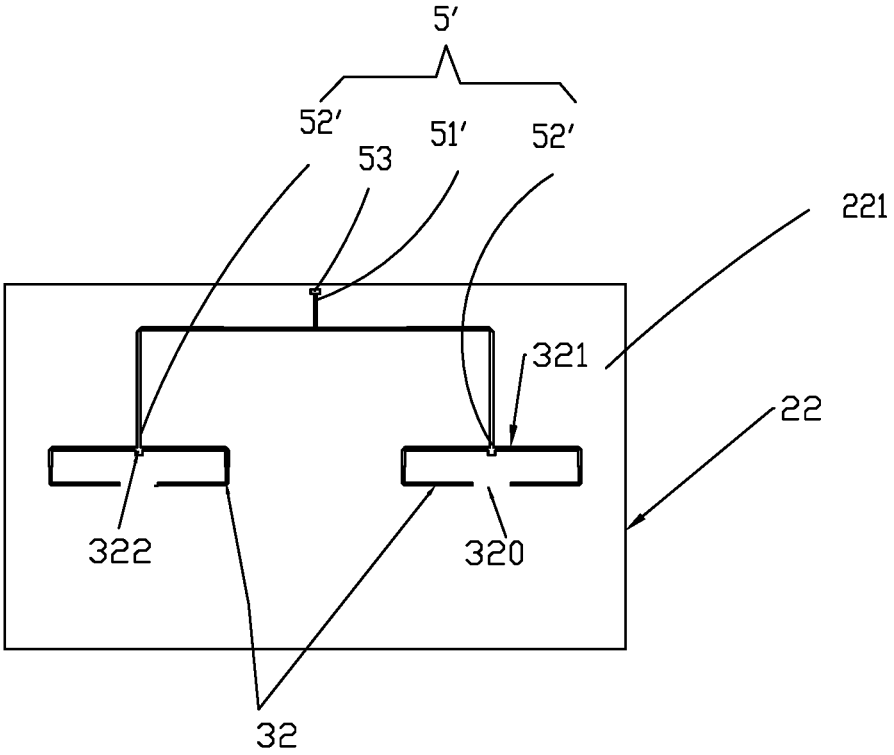
Figure 5:
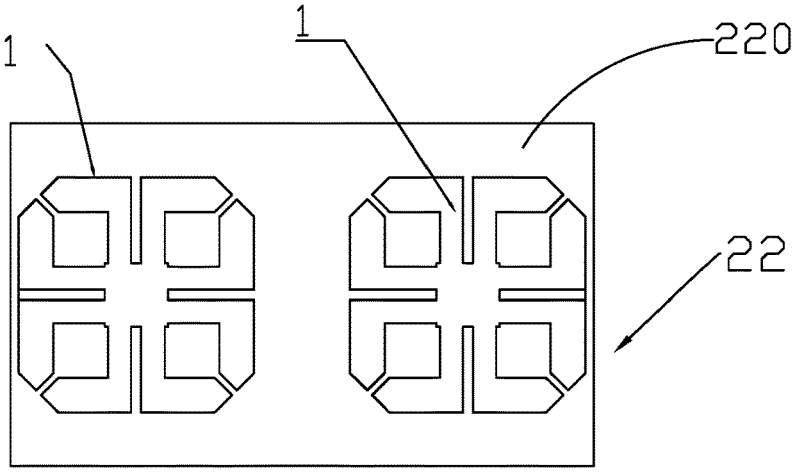
Figure 6:
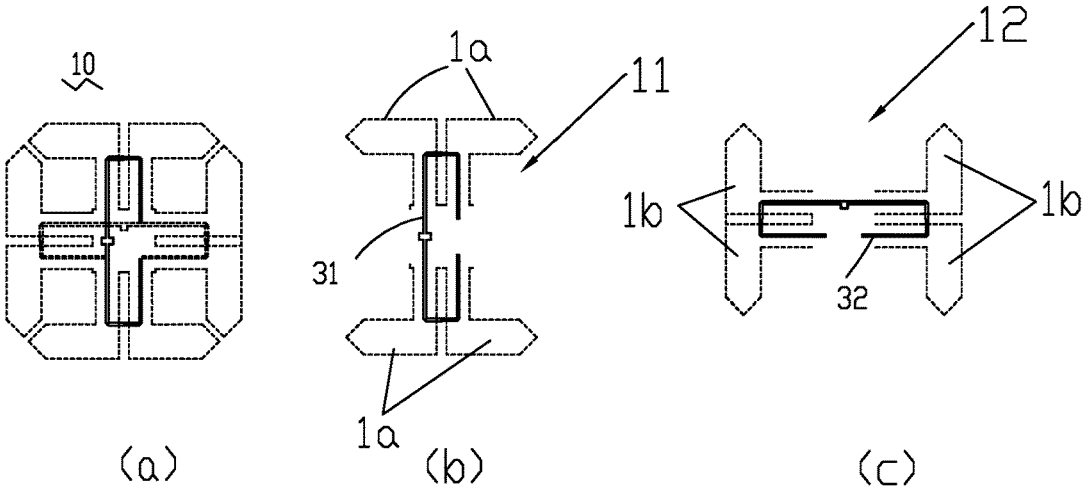
Figure 7:
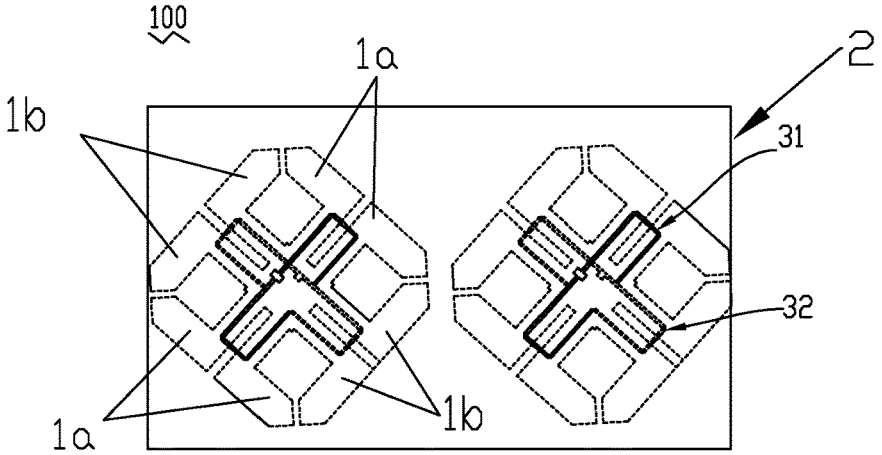
Figure 8:
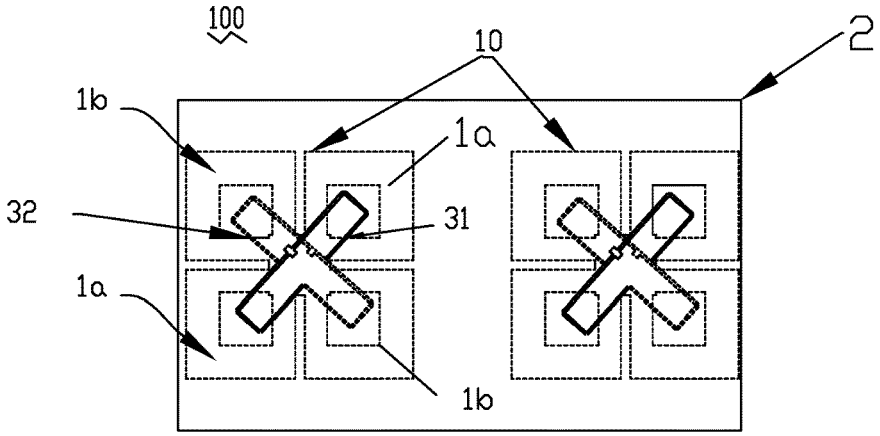
Figure 9:
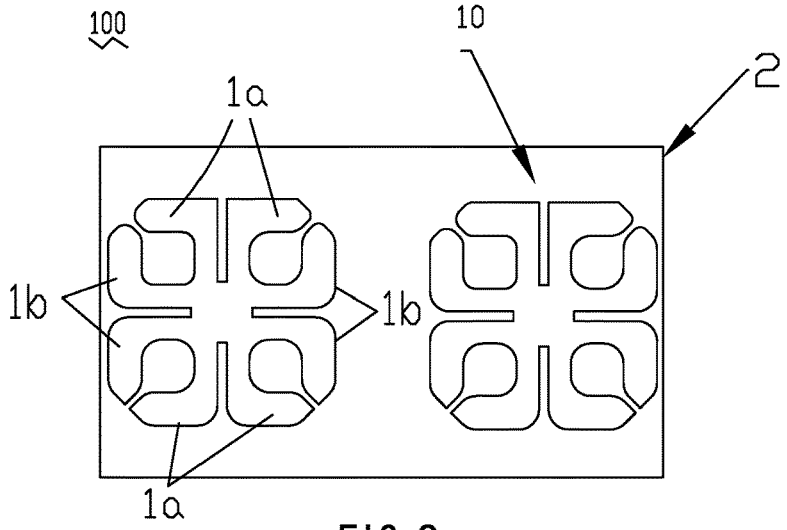
Figure 10:
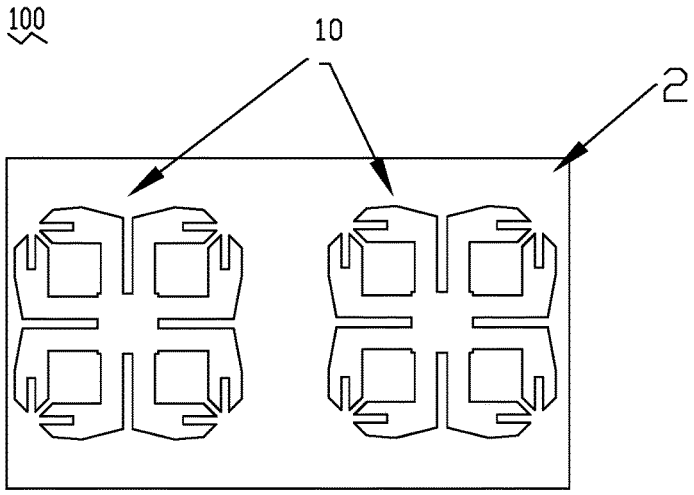
Figure 11:
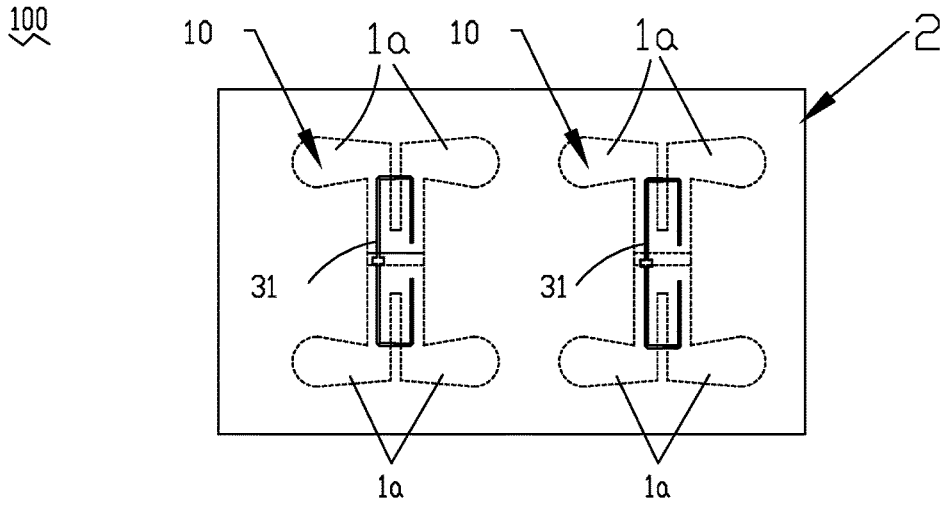
Figure 12:
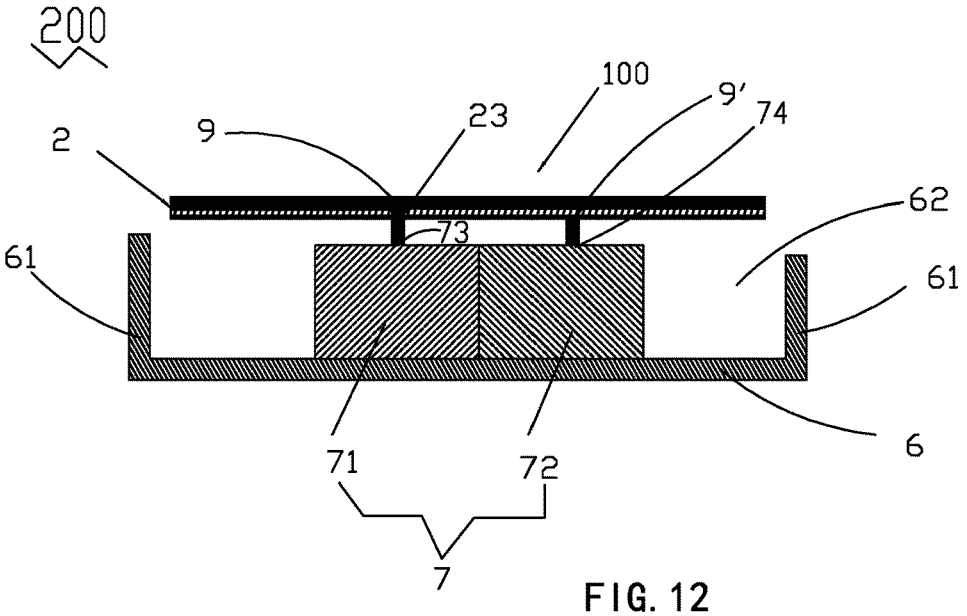
Figure 13:
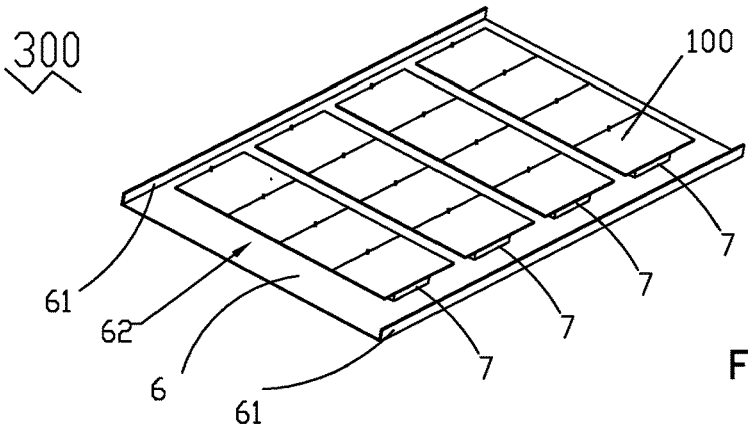
Figure 14:
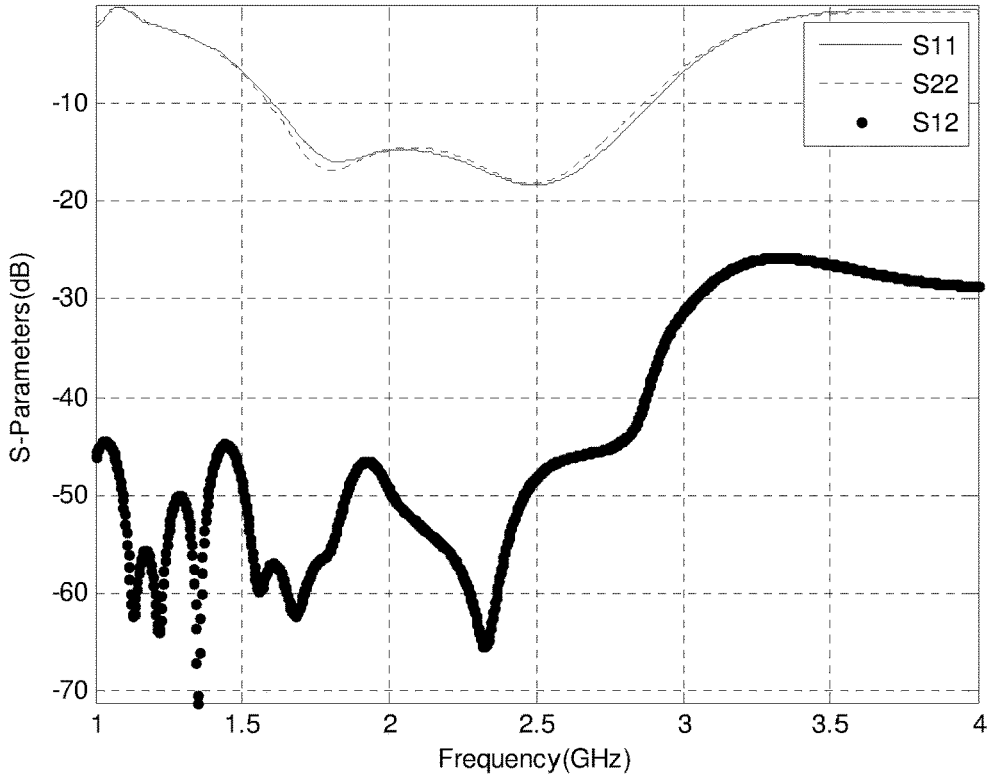
Figure 15:
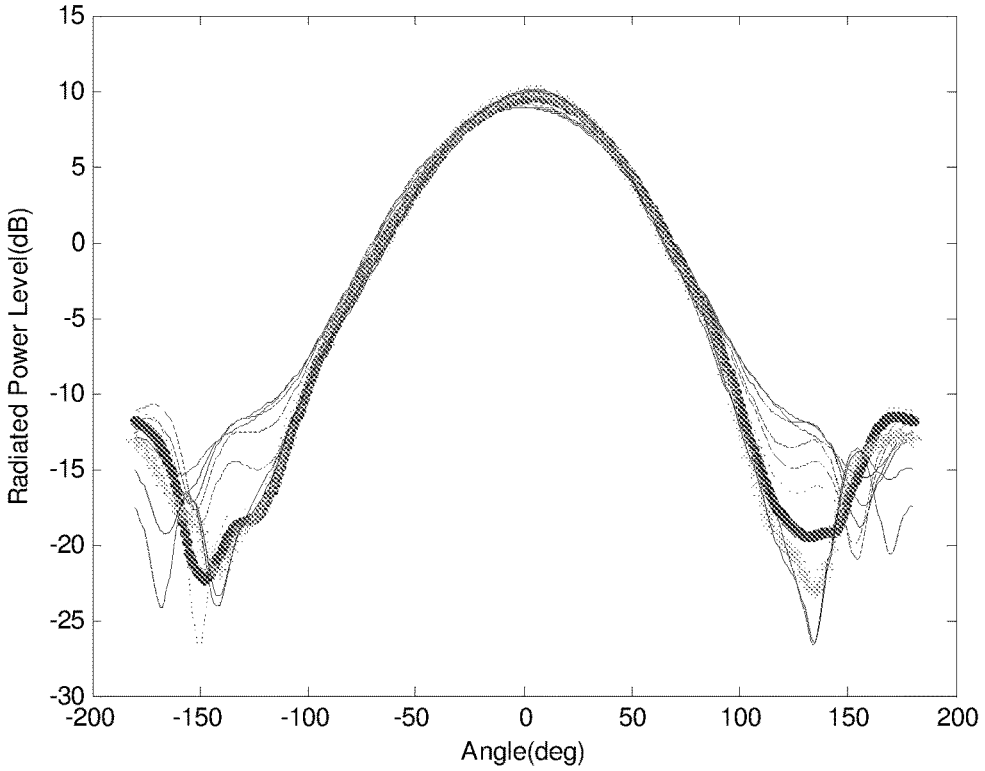

FIG. 1 illustrates a cross-sectional view of an integrated antenna element in accordance with an embodiment of the present invention;

FIG. 2 illustrates a schematic diagram of the integrated antenna element in accordance with a first embodiment of the present invention;

FIG. 3 illustrates a front view of the integrated antenna element of FIG. 2;

FIG. 4 illustrates a rear view of the integrated antenna element of FIG. 2;

FIG. 5 illustrates a front view of a bottom PCB of the integrated antenna element of FIG. 2;

FIG. 6 illustrates a schematic diagram of each radiating element of the integrated antenna element of FIG. 2, where 6(*a*) shows one radiating element of dual-polarization, 6(*b*) and 6(*c*) shows each polarization in accordance with the first embodiment of the present invention;

FIG. 7 illustrates schematic diagram of the integrated antenna element in accordance with a second embodiment of the present invention;

FIG. 8 illustrates schematic diagram of the integrated antenna element in accordance with a third embodiment of the present invention;

FIG. 9 illustrates schematic diagram of the integrated antenna element removing baluns in accordance with a fourth embodiment of the present invention;

FIG. 10 illustrates schematic diagram of the integrated antenna element removing baluns in accordance with a fifth embodiment of the present invention;

FIG. 11 illustrates schematic diagram of the integrated antenna element in accordance with a sixth embodiment of the present invention;

FIG. 12 illustrates a cross-sectional view of an antenna unit in accordance with an embodiment of the present invention;

FIG. 13 illustrates a perspective schematic view of a multi-array antenna in accordance with an embodiment of the present invention;

FIG. 14 represents S-parameter of compact radiating element (radiating surface with layered-balun); and FIG. 15 represents Radiated power level.

BEST MODE FOR CARRYING OUT THE INVENTION

Best Mode

The provided figures and the following description of certain embodiments of the invention are not intended to limit the invention to these embodiments, but rather, are provided to enable any person skilled in the art to make and use this invention.

Referring to FIG. 1, an integrated antenna element 100 provided in accordance with one embodiment of the present invention, comprises: a compact printed board 2 with a top surface 210 and a bottom surface 221, a layered-balun 3 and a radiating surface unit 1. The layered-balun 3 and the radiating surface unit 1 are coupled to form a radiating element 10 which is integrated with the compact printed board 2.

The compact printed board 2 comprises two PCBs laminated and opposite each other. The two PCBs are denoted as a top PCB 21 and a bottom PCB 22 each with an inner surface 211 and 222 opposite each other. The top surface 210 is exposed to the space, and also as one surface of the top PCB 21 opposite to the inner surface 211 thereof; while the bottom surface 220 also is one surface of the bottom PCB 22 opposite to the inner surface 221 thereof.

The layered-balun 3 comprises two separated layers, respectively denoted as a first balun 31 and a second balun 32, spaced from each other. The radiating surface unit 1 is located between and spaced from both the two baluns 31, 32, and preferably printed or etched on one inner surface of the first or bottom PCB. Preferably, the first balun 31 is attached, such as by printing or etching, on the top surface 210 of the top PCB 21, and the second balun 32 is attached, such as by printing or etching, on the bottom surface 22 of the bottom PCB 22; and the radiating surface unit 1 is inserted between the top and bottom PCBs 22, 23, specifically is attached on an inner surface 211 of the top PCB 21 or on an inner surface 220 of the bottom PCB 22.

Each compact printed board 2 can be integrated with a plurality of radiating elements 10, the same baluns for the same polarization are set on the same plan.

The radiating element 10 of the present invention can be applied for dual-polarization, single-polarization, circular polarization, and so on. The radiating surface unit 1 is adapted for the dipoles, and the structure of the layered-balun is not limited but coupled to the radiating surface unit 1 to form the dipole.

In accordance with a first embodiment, referring to FIGS. 2-6, the integrated antenna element 100, comprises:

the compact printed board 2 comprising the top PCB 21 and the bottom PCB 22 in a layered structure; and at least two radiating elements 10, where each radiating element 10 comprises one radiating surface unit 1 and the layered-balun 3, and features dual-polarized with one dipole 11, 12 for each polarization. The radiating surface unit 1 and the layered-balun 3 are coupled to form one radiating element 10.

The radiating surface unit 1 is located between two PCBs 21, 22, in a sandwich-like format; and is printed or etched on the inner surface of the first or the bottom PCB 21, 22. The radiating surface unit 1 is substantially a radiating strip, and can be made from metal sheets or from sheet or strip of other conductive materials. The shape and structure of radiating surface unit 1 is not limited and can be any type such as circular, square, polygon etched shape. There are at least two radiating surface units 1 according to the number of the radiating elements 10. Each unit 1 has a shape corresponding to the dipoles. As an illustrated example, each unit 1 is in a shape of a square combined by four symmetrical sub-squares each with a hole (not labeled) therein. The radiating surface units 1 are coupled to the layered-balun 3, in a pattern, location, and electric radiating performance, so as to form the dual polarizations. Both radiating surface units 1 are attached to the inner surface of the compact PCB 2 and separately opposite to the layered-balun 3, and as an exemplary embodiment, are printed on an inner surface 220 of the bottom PCB 21 (as shown in FIG. 5).

The layered-balun 3 comprises two parts, each part serves for different polarizations and is located at separated PCB 21, 22, or respectively attached on both opposite surfaces of the compact printed board 2. In one embodiment, the layered-balun 3 has the first part thereof printed on the top surface 210 of the compact printed PCB 2 to form a first balun 31 for one polarization such as vertical polarization, while the second part thereof printed at the bottom surface 221 of the compact printed PCB 2 to form a second balun 32 for the other polarization such as a horizontal polarization.

The first balun 31 and the second balun 32 are arranged in a cross position and coupled to the radiating surface unit 1 to form the dual-polarized dipoles 11, 12 of each radiating element 10. The balun 31, 32 is made from metal or other conductive materials, such as metal wire or strip, and is attached or printed on the surface of the PCB in a line or strip configuration. Preferably, a transmission line or feed line attached on the compact printed board 2 is used as the balun 31 and 32. As matter of illustration, each balun 31, 32 is configured as a rectangular line 311, 321 with one part cut 310, 320; the cut 310, 320 is located in the middle of one length of the rectangle as an exemplary illustration as shown in FIGS. 3-4.

In this embodiment, the first balun 31, the second balun 32 and the radiating surface unit 1 are spaced along the height of the compact printed board 2. The first balun 31 and the second balun 32 are respectively located at a top and at a bottom of the radiating surface unit 1. The first balun 31 and the second balun 32 are located at a separated board 21, 22 of the compact print board 2.

In a dimensional arrangement, the first balun 31 and the second balun 32 are positioned to form a complete cross at a center of the square of the radiating surface unit 1 to form a dual polarization. There are at least two first baluns 31 all in the same plane attached on the top surface 210 of the top PCB 21, parallel to each other at a distance therebetween according to that of the two radiating elements 10. So there are at least two second baluns attached on the bottom surface of the bottom PCB 22 and parallel to each other all in the same plane.

It is understood that the baluns 31, 32 are not limited to the rectangle line, other shapes adapted to the dual polarization can be used too. The balun topology and its length can be tuned to match 50 or 75 Ohm impedance of each dipole. As matter of illustration, the rectangular line 311,321 with one part cut 310,320 is used to output bandwidth of more than 45% when a return loss less than −14 dB is required covering 1710~2690 MHz with good inter-port isolation, stable pattern beamwidth and high-gain for one radiating element, as shown in FIGS. 14-15. Other balun topology can be adopted also with quarter wave transformers to match impedance at desired frequency range.

A primary power splitter 5 is printed or attached on a top surface 210 of the top PCB 21 with one input 51 and at least two outputs 52 where the two outputs 52 are connected each to one first balun 31 via a hole 312 thereof to support the balun 31. A secondary power splitter 5' is printed or attached at the bottom surface 221 of the bottom PCB 22 with one input 51' and at least two outputs 52' where the two outputs 52' are connected each to one balun 32 via a hole 322 thereof to support the balun 32. The primary and secondary power splitters 5, 5' are given as mater of illustration. They can be 1:3 or more splitting mechanism where three or more radiating elements 10 are to be connected. In one embodiment, the hole 312, 322 is set in another length of the rectangular line opposite to the cut 310, 320.

The layered-balun 3 of the present invention can be tuned to match 50 or 75 Ohm impedance of each dipole. As matter of illustration, particular rectangular line (with one part cut) is used to output bandwidth of more than 45% when a return loss less than −14 dB is required covering 1710~2690 MHz with good inter-port isolation, stable pattern beamwidth and high-gain for one radiating element, as shown in FIGS. 14-15. Other balun topology can be adopted also with quarter wave transformers to match impedance at desired frequency range.

FIGS. 2 and 6 illustrate a schematic diagram of the integrated antenna element 100 and its radiating element 10, while the layered-balun 3 and the radiating surface unit 1 are substantially located at different PCBs and have no direct contact with each other. Similarly, FIGS. 7-10 just are schematic diagram of the integrated antenna element 100 and its radiating element 10 too, the layered-balun 3 and the radiating surface unit 1 have no direct contact therebetween, while are separately spaced, and yet the first and second baluns of the layered-balun 3 have no direct contact while are separately spaced from each other, and specifically attached on different PCBs 21 and 22.

The radiating element 10 in FIG. 6 (*a*) is dual-polarized comprises the first dipole 11 of a vertical polarization and the second dipole 12 of a horizontal polarization a, each polarization for one dipole. The radiating surface 1 has two pairs of radiating arms 1*a* and 1*b* orthogonal to each other, a pair of vertical radiating arms 1*a* is coupled to the first balun 31 along its vertical center line to form the vertical polarization, and a pair of horizontal radiating arms 1*b* is coupled to the second balun 32 along its horizontal center line to form the horizontal polarization.

a second embodiment, the integrated antenna element 100 shown in FIG. 7 comprises at least two radiating elements of ±45° polarization. Each radiating element comprises the layered-balun 3 and the radiating surface unit 1. The layered-balun 3 has each balun set at different PCBs, and the radiating surface unit 1 is set between two PCBs 21 and 22. The first balun 31 is coupled to a first pair radiating arms 1*a* of the radiating surface unit 1 to form a first dipole 11, while the second balun 32 is coupled to a second pair radiating arms 1*b* of the radiating surface unit 1 to form the second dipole 12. The first and second dipoles form ±45° polarization.

In a third embodiment, the integrated antenna element 100 as shown in FIG. 8 has the compact printed board 2 integrated with square folded dipole of dual-polarization. The layered-balun 3 has each balun set at different PCBs, and the radiating surface unit 1 is set between two PCBs 21 and 22. The first balun 31 is coupled to a first pair radiating arms 1*a* of the radiating surface unit 1 to form a first dipole 11, while the second balun 32 is coupled to a second pair radiating arms 1*b* of the radiating surface unit 1 to form the second dipole 12. The first and second dipoles form ±45° polarization.

In a fourth embodiment, the integrated antenna element 100 as shown in FIG. 9 has the compact printed board 2 integrated with modified folded dipole of dual-polarization. The layered-balun 3 (not shown) with each balun set at different PCBs, is adapted for the radiating arms 1*a* and 1*b* and coupled to the radiating surface unit 1 to form dual-polarized dipoles.

In a fifth embodiment, the integrated antenna element 100 as shown in FIG. 10 has the compact printed board 2 integrated with another modified folded dipole of dual-polarization. The layered-balun 3 (not shown) with each balun set at different PCBs, is adapted for the radiating arms 1*a* and 1*b* and coupled the radiating surface unit 1 to form dual-polarized dipoles.

In a sixth embodiment, the integrated antenna element 100 as shown in FIG. 11 has only one PCB board as the compact printed board 2 that can be placed on top or bottom of the radiating element 10. The compact printed board 2 integrated with radiating elements 10 of a single polarization. The radiating element 10 has only one balun 3 attached on one surface such as the top surface 210 of the compact printed board, while the radiating surface 1 attached on the other surface such as the bottom surface 221 comprises a pair of radiating arm 1*a* without the pair of radiating arm 1*b*.

In another embodiment, by applying a dual-feed balun with one feed having 90 degree offset phase, a circular polarization can be obtained with the sixth dipole above.

Further, a folded shape of the dipole depends on the desired electrical length of the current.

In some embodiments, the balun 3 is a layered-balun; the layered-balun comprises a first balun 31 and a second balun 32 each separately set on the different PCB 21,22, the radiating surface unit 1 is sandwiched between the first balun 31 and the second balun 32; or, the first balun 31 and second balun 32 are overlapped to form a fly-over structure and are attached on the same plan of the compact board; two baluns are not intersect with each other; and one of the baluns is broken, and re-connect with a 0-Ohm resistor, patch or wire.

In other embodiments, various radiating elements can be integrated with the compact printed board 2 to form the integrated antenna element 100 of the present invention.

An antenna unit 200 provided in accordance with an embodiment of the present invention, comprises the integrated antenna element 100 described above, a reflecting board 6 and filtering equipment 7, referring to FIG. 12. The reflecting board 6 is placed below the integrated antenna element 100 with two side walls 61 running parallel enabling to control the 3 dB azimuth beam generated by the radiating elements. The pair of running parallel side walls 61 extends from a bottom of the reflecting board 6 towards the compact printed board 2. The reflecting board 6 is spaced from the compact printed board 2 without direct contact therebetween, for example, with a distance of ¼λ, where λ is the wavelength at a center frequency of the radiating element. There is a space 62 between the reflecting board 6 and the compact printed board 2. The filtering equipment 7 is accommodated in the space 62 between the compact printed board 2 and the reflecting board 6.

The filtering equipment 7, is mounted on the reflecting board 6, has at least two inputs and at least two outputs thus to form a dual-channel structure. Accordingly, the filtering equipment 7 comprises at least two band-pass filters according to the at least two radiating element 10, denoted as a primary band-pass filter 71 and a secondary band-pass filter 72 which can be made from ceramics, sheet metal cavity, or others. The primary band-pass filter 71 has one input (not shown) and one output 73 is placed beneath the radiating elements 10. The output 73 is connected directly to the primary power splitter 5 via a matched transmission line 9. Preferably, the matched transmission line 9 is a cable 9, traverses a filter cavity of the filter 71 via a hole (not labeled), and connects with the input 51 of the splitter 5 via a through hole 23 along the height of the compact print board 2. The band-pass filter 71 serves as a support of the fixture structure of the integrated antenna element 100 to the reflecting board 6. Particularly, the matched transmission line 9, namely, the cable 9 from the filter 71 supports the integrated antenna element 100 including compact printed board 2 and the at least two radiating element 10.

The secondary band-pass filter 72 has one input (not shown) and one output 74 is placed beneath the compact radiating elements 10. As same as the primary band-pass filter 71, the band-pass filter 72 serves support of the fixture structure of another radiating elements 10 to the reflecting board 6. The output 74 is connected directly to the secondary power splitter 5'. The connection can be made of matched transmission line 9'. The transmission line 9' traverses a filter cavity of the filter 72 through a hole (not labeled) in the top of the filter box, and connects with the input 51' of the secondary band pass filter 72 via a hole 53 of the splitter 5'. The matched transmission line 9', namely, the cable 9' from the filter 72 supports the integrated antenna element 100 including compact printed board 2 and the at least two radiating element 10.

The primary and secondary band-pass filters 71, 72 can be housed in same box sharing same cavity or housed in separate boxes with different cavity to form the filtering equipment 7 of the present invention. The parameter adaptation depends on the size and filtering performances requested by the base station radio module.

The dual-channel filtering equipment 7 is placed between the radiating element 10 and the reflecting board 6; therefore, the space 62 between the radiating elements 10 and the reflecting board 6 can be used efficiently by adding the compact band-pass filter 71, 72. The transmission line 9, 9' directly connects the input 51, 51' of each power splitter 5, 5' to one filter-channel through the hole 53 of the filters, and further supports the radiating elements 10. The splitter 5, 5' is connected to the first and second baluns 31, 32 via the hole 312, 322 to support the baluns, which simplify the structure and the feeding lines of the antenna unit, reduce connectors, and avoid multiple soldering points.

It is understood that the integrated antenna element can comprises more radiating elements of dual polarization; accordingly, more radiating surface units 1 are sandwiched between the first and bottom PCBs 21, 22, more first baluns 31 each connected to one output of the primary power splitter 5 are set on the same plane such as the top surface 210 of the top PCB 21, more second baluns 32 each connected to one output of the secondary power splitter 5' are set on the same plane such as the bottom surface 221 of the bottom PCB 22; and more band-pass filters set on the reflecting board 6 and under the compact printed board 2 each with one cable 9 or 9' connecting the radiating elements 10 and the compact printed board 2.

In a transmission mode, the primary and secondary band-pass filters 71, 72 keep each only the narrow-band of interest from a base station antenna transmitting path. The output 73 or 74 of the primary and the secondary filters 71, 72 are sent to the primary and secondary power splitters 5, 5' respectively. And the primary and secondary power splitter 5, 5' splits each its input signal and sends it to the corresponding radiating elements 10 via the respective balun 31, 32. Each radiating element 10 radiates its received signal throughout the space.

In a receiving mode, each radiating element 10 sends its received signal to the corresponding power splitter 5, 5' via respective balun 31, 32. The output of each power splitter 5, 5' is received at the corresponding band-pass filter 71, 72 which keeps filtered signal of interest that can be forwarded to a base station antenna receiving path.

Therefore, a transmitting method comprises: receiving signals from a base station antenna transmitting path via two inputs of the dual-channel band-pass filtering equipment; filtering signals and outputting the signals to the outputs of the primary and secondary power splitters; splitting each input signal using the splitters; sending the signals to the corresponding radiating elements 10 via the respective balun 31, 32 each located at a separated PCB; and radiating its received signal throughout the space by the radiating elements.

A receiving method comprising: receiving signals using the radiating elements; sending the received signals to the corresponding power splitter 5, 5' via respective balun 31, 32; receiving the outputting signals of the splitters 5, 5' and filtering the signals by the corresponding band-pass filter 71, 72; sending filtered signal of interest to a base station antenna receiving path.

It is understood that, in various embodiments, the first balun 31, the second balun 32 and the radiating surface unit 1 are spaced thus have no contact each other, the radiating surface unit 1 is sandwiched therebetween, and all are coupled to form the dipoles of each radiating element 10.

A Massive MIMO (large-scale array) antenna 300 proposed in accordance with an embodiment of the present invention is obtained by collocating several above antenna units 200 which are mounted on the reflecting board 6 and located between the two parallel side walls 61, each antenna unit 100 forms a sub-array. FIG. 13 shows a part of the MIMO antenna 300, which comprises multi-array integrated antenna element 100 mounted on an extended reflecting board 6, particularly, the multi-array integrated antenna element 100 are supported on the reflecting board 6 each supporting by one filtering equipment 7. Thus the MIMO antenna 300 has multiple band-pass filters 7. The extended reflecting board 6 has two parallel side walls 61 running upwards to enclose all the antenna integrated units 100 therebetween.

Further, the inputs of the multiple band-pass filters 7 can be connected to a radio unit; so that multi-array active antennas can be obtained.

In various embodiments, the integrated antenna element 100, antenna units 200, and a multi-array integrated antenna 300 are provided. The integrated antenna element 100 is proposed where at least two radiating elements 10 of dual-polarization, single-polarization, or circular polarization, are connected between two PCBs 21 and 22 serving as balun support. The first polarization has its balun 31 located on the top surface 210 while the second one has its balun 32 at the bottom surface 221 of the compact printed board 2. Each balun 31, 32 is connected at least to one 1:2 power splitter 5, 5' via a hole 312, 322; so that a compact multi-radiating elements unit can be obtained on a compact printed board 2. A reflecting board 6 is placed around ¼ wavelength of the compact board 2. A dual-channel band-pass filtering equipment 7 having two inputs (not shown) and two outputs 73, 74 is placed beneath the compact board 2 and on the reflecting board 6 where a transmission line 9, 9' connecting the input 51, 51' of each power splitter 5, 5' to one filter-channel. Next, a multi-array antenna is proposed by collocating several integrated antenna elements known as a large-scale array antenna 300.

As used in the description and claims, the singular form "a", "an" and "the" include both singular and plural references unless the context clearly dictates otherwise. At times, the claims and disclosure may include terms such as "a plurality," "one or more," or "at least one;" however, the absence of such terms is not intended to mean, and should not be interpreted to mean, that a plurality is not conceived.

As used herein, the term "comprising", "composed of" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a system or method consisting essentially of the elements as defined herein would not exclude other materials, features, or steps that do not materially affect the basic and novel characteristic(s) of the claimed invention. "Consisting of" shall mean that the devices, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The invention claimed is:

1. An integrated antenna element comprising:

a top printed circuit board (PCB) and a bottom PCB arranged in a laminate structure along a thickness direction;

a plurality of radiating surface units arranged between the top PCB and the bottom PCB in the thickness direction; and a layered-balun comprising a first balun and a second balun, the first balun being arranged on a top exterior of the top PCB, and the second balun being arranged on a bottom exterior of the bottom PCB;

wherein the first balun, the second balun, and the radiating surface units are spaced apart from each other in the thickness direction.

2. The integrated antenna element of claim 1, wherein the first and second baluns are set in the same plane when viewing the integrated antenna element along the thickness direction, in a plan view.

3. The integrated antenna element of claim 1, wherein the first balun is attached to the top PCB for a first polarization and the second balun is attached to the bottom PCB for a second polarization.

4. The integrated antenna element of claim 1, wherein the top PCB is placed on the bottom PCB each with an inner surface facing the other PCB;

the first balun is coupled to the radiating surface units to form a first dipole for a first polarization; the second balun is coupled to the radiating surface units to form a second dipole for a second polarization; and the radiating surface units are set on the inner surface of the top PCB or the inner surface of the bottom PCB.

5. The integrated antenna element of claim 1, wherein in a plan view the first balun and the second balun are overlapped to form a cross at a center of the radiating surface units in such a dimensional arrangement so as to form a dual polarization.

6. The integrated antenna element of claim 1, wherein the radiating surface units each comprise radiating arms; and each of the radiating arms has a folded shape that depends on an electrical length of a current in a corresponding radiating surface unit.

7. The integrated antenna element of claim 1, further comprising:

a primary power splitter comprising one input and at least two outputs that is set on the top PCB with each output thereof connected to the first balun; and a secondary power splitter comprising one input and at least two outputs that is set on the bottom PCB with each output thereof connected to the second balun.

8. The integrated antenna element of claim 7, wherein the power splitter is connected to the layered-balun via holes in the layered-balun.

9. The integrated antenna element of claim 1, wherein a radiating element is formed by each of the radiating surface units and the layered balun;

the radiating surface units are made from a conductive material, and have a shape corresponding to dipoles of each radiating element; and the first and the second baluns are made from a conductive material, and the first and second baluns are adapted for the radiating surface units.

10. The integrated antenna element of claim 1, wherein the radiating surface units are each configured as a square strip comprising four sub-squares each with a hole therein; and the first and the second baluns are each configured so as to comprise a rectangle with one part cut; the cut being located in the middle of one length of the rectangle.

11. The integrated antenna element of claim 1, wherein the first and the second baluns have each a length to match 50 or 75 Ohms impedance of each dipole.

12. An antenna unit comprising: the integrated antenna element of claim 1, a reflecting board, and filtering equipment, wherein the reflecting board is placed below the integrated antenna element.

13. The antenna unit of claim 12, wherein the filtering equipment is accommodated in a space between the integrated antenna element and the reflecting board, and is set on the reflecting board.

14. The antenna unit of claim 12, wherein a radiating element is formed by each of the radiating surface units and the layered balun, and the reflecting board is placed below the integrated antenna element with two side walls running parallel; the reflecting board is parallel to the integrated antenna element with a distance of $\frac{1}{4}\lambda$, where $\lambda$ is the wavelength at a center frequency of each radiating element.

15. The antenna unit of claim 12, wherein the filtering equipment has at least two inputs and at least two outputs that form a dual-channel structure.

16. The antenna unit in claim 15, wherein the filtering equipment comprises:

a primary band-pass filter and a secondary band-pass filter;

the primary band-pass filter has one input and one output, the output is placed beneath the integrated antenna element, and is connected directly to a primary power splitter via a matched transmission line; and the secondary band-pass filter has one input and one output, the output is placed beneath the integrated antenna element, and is connected directly to a secondary power splitter via another matched transmission line.

17. The antenna unit of claim 16, wherein each band-pass filter serves as a support of a fixture structure of the integrated antenna element to the reflecting board.

18. The antenna unit of claim 16, wherein a radiating element is formed by each of the radiating surface units and the layered balun, and the matched transmission line is a cable traversing a filter cavity of each band-pass filter via a hole in a top of the band-pass filter; the cable connects the integrated antenna element and each radiating element above the reflecting board.

19. A multi-array antenna comprising multiple antenna units of claim 12, wherein the multiple antenna units are mounted on a reflecting board, and located between two running side walls of the reflecting board.

20. The multi-array antenna of claim 19, wherein the multi-array antenna comprises multiple band-pass filters, and the multiple band-pass filters are connected to a radio unit so as to form a multi-array active antenna.

21. A transmitting method of an integrated antenna unit comprising:

receiving signals from a base station antenna transmitting path via two inputs of a dual-channel band-pass filtering apparatus;

filtering the received signals and outputting the filtered signals to inputs of a primary power splitter and a secondary power splitter;

splitting each input filtered signal using the primary power splitter and the secondary power splitter;

sending the split signals to a corresponding radiating element via a primary balun and a secondary balun, each of the primary balun and the secondary balun being located on a separate printed circuit board (PCB); and radiating the split signals throughout a space by each corresponding radiating element.

22. A receiving method of an integrated antenna unit comprising:

receiving signals using radiating elements;

sending the received signals to a corresponding power splitter via a respective balun;

splitting the received signals with the corresponding power splitter;

filtering the split signals with a corresponding band-pass filter; and sending the filtered signal to a base station antenna receiving path.

* * * * *